United States Patent [19]

Brownbill

[11] Patent Number: 4,598,835

[45] Date of Patent: Jul. 8, 1986

[54] ONE-PIECE PLASTICS CLOSURE

[75] Inventor: Thomas D. Brownbill, Stepwood, England

[73] Assignee: Metal Box Public Limited Company, Berkshire, England

[21] Appl. No.: 663,238

[22] Filed: Oct. 22, 1984

[30] Foreign Application Priority Data

Oct. 29, 1983 [GB] United Kingdom ..... 8328954

[51] Int. Cl.[4] ..... B65D 53/00

[52] U.S. Cl. ..... 215/307; 215/344; 215/DIG. 1

[58] Field of Search ..... 215/344, DIG. 1, 260, 215/270, 307

[56] References Cited

U.S. PATENT DOCUMENTS 3,067,900 12/1962 Kessler ..... 215/344 X
3,901,404 8/1975 Feldman ..... 215/344 X
4,125,201 11/1978 Birch ..... 215/344 X
4,220,250 9/1980 Brownbill ..... 215/344 X
4,461,392 7/1984 Conti ..... 215/344 X

*Primary Examiner*—Donald F. Norton
*Attorney, Agent, or Firm*—Christie, Parker & Hale

[57] ABSTRACT

A one-piece plastics closure for a carbonated beverage bottle has a sealing ring (17) pivotally attached at the junction between its closure panel (10) and dependant skirt (11). The sealing ring is forked, having two annular and mutually divergent fins 20,21. The upper fin (20) is engaged by the free end of the container neck as the closure is fitted, and by pivotal movement of the sealing ring brings the lower fin (21) into sealing relation with the side surface of the container finish. The resilience of the closure material and the substantial deformation to which the sealing ring is subject thereafter maintain the effectiveness of the seal despite creep and backing-off of the closure which may occur.

7 Claims, 4 Drawing Figures

ONE-PIECE PLASTICS CLOSURE

This invention relates to a one-piece plastics closure for a container, that is to say, to a plastics container closure of the kind having an integrally moulded sealing member. This is to be contrasted with a "two-piece" plastics closure, in which the sealing member is a separate member which is usually added by a post-operation after moulding; one known two-piece closure has a sealing gasket formed of a plastisol lining compound which is flowed as a liquid into position within the moulded closure, and then cured to solidify it.

Many proposals have been made for one-piece plastics screw closures for carbonated beverage bottles, but these prior art closures have been prone to loss of carbonation pressure over extended periods of time, largely because of creep or relaxation of the plastics material of which they are made, and backing-off of the closure as a whole. The desirability that the closure should seal against the side of the bottle neck is well known, but efficient and reliable sealing at this location has been found difficult to achieve in practice, particularly where the bottle neck dimensions have been subject to wide dimensional variation. The present invention seeks to provide a one-piece plastics closure which is adapted to seal on the side of the container neck and which is capable of doing so over an extended period of time despite material creep and backing-off of the closure which may occur in the course of normal transit, display and storage.

According to the present invention from one aspect there is provided a one-piece plastics closure for a container having a mouth-defining free end surface and a side surface, the closure having a closure panel, a skirt depending peripherally from the closure panel, and an annular sealing member located adjacent the junction of the closure panel and the skirt and attached by an integral hinge allowing pivotal movement of the sealing member, the sealing member having a first portion located for engagement with the free end surface of a said container when the closure is fitted on the container, and a second portion located so as in reponse to such engagement of the first portion by the container to be urged into engagement with the side surface of the container and thereby form a side seal for the container.

Advantageously the sealing member is a forked member having a body portion attached by the integral hinge, and first and second mutually divergent annular fins carried by the body portion and respectively forming the said first and second portions of the sealing member. The first fin (forming the first portion) may be capable of forming a seal in series relation to that provided by the second, side-sealing fin, but for venting purposes it may be desirable to ensure that the first fin cannot form a seal with the container. To that end the first fin may be formed of mutually spaced segments.

The fitted or fully home position of the closure may be determined by engagement of the first portion with the closure panel, preferably at an annular projection which extends around the underside of the closure panel for engagement by the first portion in opposition to the engagement of the first portion by the container. As an alternative, however, the sealing member alone may determine the fitted position of the closure.

These and other aspects and features of the invention will become apparent from the following description of a closure in accordance with the invention, now to be given by way of example and with reference to the accompanying drawings, in which.

Figure 1:
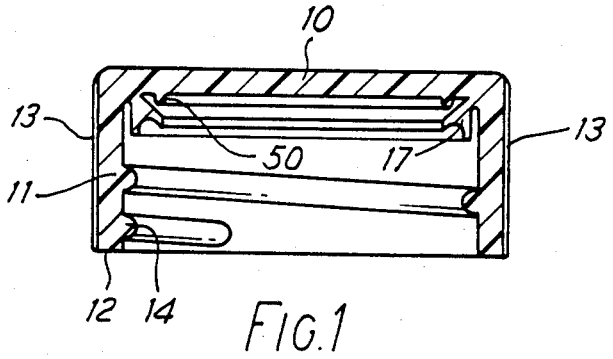
FIG. 1 shows the closure in diametral section.
Figure 2:
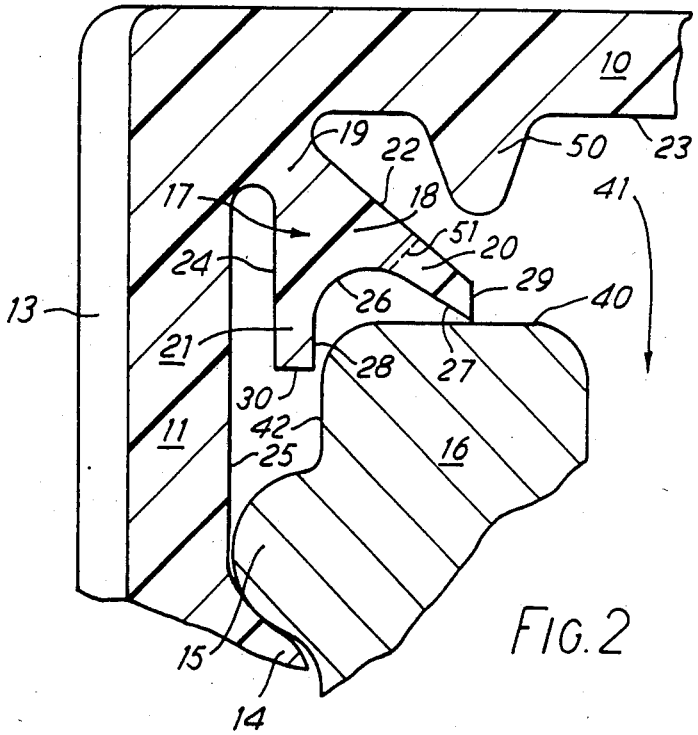
FIG. 2 shows a detail of the closure during fitting to a bottle neck, in enlarged, diametral section.
Figure 3:
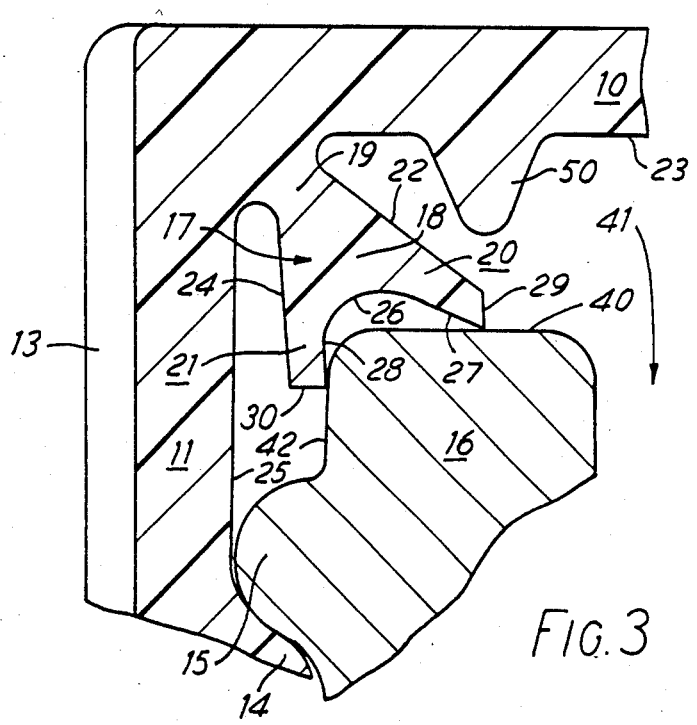
FIG. 3 is a similar view of the closure at a later stage of its fitting to the bottle neck.
Figure 4:
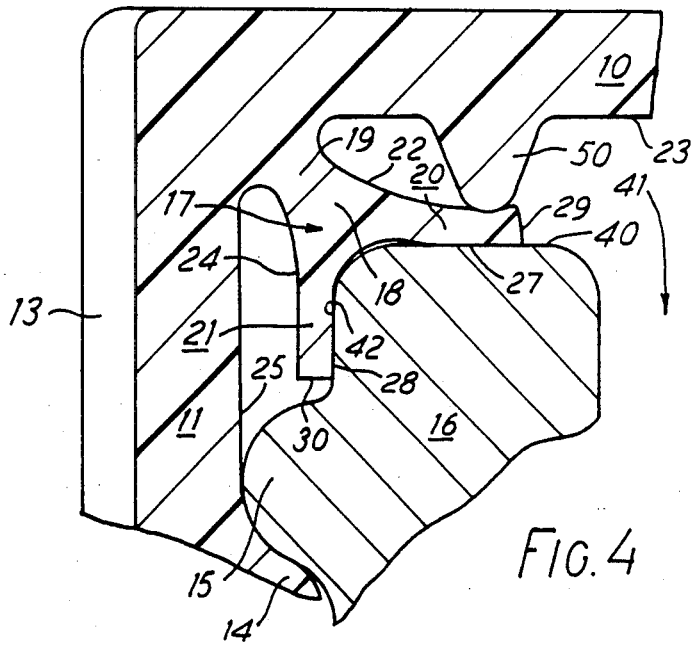
FIG. 4 is a similar view of the closure when fitted to the bottle neck.

Referring firstly to FIG. 1 of the drawings, a screw closure of a suitable thermoplastics resin material such as polypropylene is injection-moulded to have a generally plane closure panel 10 and a depending peripheral skirt 11 extending to a free edge 12. The skirt is formed with a conventional screw thread 14 for engagement in known manner with a complementary screw thread 15 on a bottle neck 16 (FIGS. 2 to 4). The bottle may, for example, be a glass or plastics (e.g. PET) bottle for a carbonated beverage product such as a beer.

As is clearly shown in FIGS. 2 to 4, a sealing ring 17 is located within the closure at the corner or elbow between the closure panel 10 and the skirt 11. The sealing ring is moulded with, and as an integral part of, the closure. It is attached to the remainder of the closure by an integral neck 19 which is rooted at the elbow and is capable of forming a hinge for the sealing ring as will later become apparent.

The sealing ring is annular and continuous. In cross-section it is forked, having an upper fin 20 and a lower fin 21 which are carried by a body portion 18 of the sealing ring and which extend in a divergent manner away from the neck 19 for engaging, respectively, the top and side faces of the finish of the container neck 16 as will become apparent.

The upper fin 20 is substantially parallel-sided and frustonconical, being inclined at approximately equal angles to the closure panel 10 and skirt 11. It has a cylindrical free edge 29.

The lower fin 21 is parallel-sided and cylindrical, extending vertically downwards in parallel, spaced relation to the skirt 11. It terminates at an annular free edge 30.

The frustoconical upper surface 22 of the upper fin 20 faces the under surface 23 of the closure panel 10 and an annular stop bead 50 projecting from the surface 23.

The cylindrical outer surface 24 of the lower fin 21 faces the skirt 11 at a cylindrical inner surface 25 of the latter above its screw thread 14.

A concavely arcuate bottom surface 26 of the body portion 18 joins the frustoconical lower surface 27 of the upper fin with the cylindrical inner surface 28 of the lower fin.

FIG. 2 shows the closure while it is being screwed onto the bottle neck, at the moment of time when the bottom corner of the upper fin 20 comes into engagement with the annular top surface 40 of the neck around the bottle mouth 41. The sealing ring at this time is thus undistorted and substantially in its as-moulded condition.

By virtue of the engagement of the upper fin with the surface 40, screwing-down of the closure beyond the position shown in FIG. 2 results in pivotal movement of the sealing ring 17 in an anti-clockwise direction about the neck 19 (which acts as an integral hinge), the upper fin being at the same time constrained to ride along the surface 40 in a radially inward direction.

As shown in FIG. 3, the pivotal movement of the sealing ring together with the relative upward movement of the bottle neck eventually bring the inner bottom corner of the lower fin 21 into contact with the bottle neck at the generally cylindrical side face 42 which the bottle neck presents above its screw threads 15. Thereafter, little or no further tilting of the sealing ring occurs, but the contact area between the surfaces 28,42 progressively increases as the closure is screwed down and the surface 28 rides down the surface 42 generally in cylindrical face-to-face contact.

It will be appreciated that the amplitude of the pivotal movement of the sealing member will vary with the diameter of the surface 42, and for necks 16 at the large end of the allowed tolerance range the movement may be small or non-existent.

Screwing-down of the closure continues until the position shown in FIG. 4 is reached. In this position the upper fin 20 has come into engagement with the annular stop bead 50, and has become firmly clamped by that bead against the free top surface 40 of the bottle. The bead 50 accordingly determines the fitted or fully home position of the closure.

As will be understood from FIGS. 2 to 4 and the description given above, the configurations of the sealing ring and bottle neck and their relative movement are such that, as screwing-up proceeds, the upper and lower fins 20,21 are progressively spread apart and distorted into conformity with their respective surfaces of the bottle neck; in particular the upper fin is flattened so as to make planar contact with the bottle neck.

The upward force on the upper fin produced by the bottle is referred to the lower fin by the body portion 18, and results in an inward, generally horizontally directed force by which the lower fin is urged against the bottle side surface 42. In order to ensure effective force transmission between the fins with little attenuation, the body portion is made as robust, and the neck 19 is made as narrow and correspondingly flexible, as moulding considerations permit.

In the fitted condition of the closure (FIG. 4), the forces and area involved at the contact between the surfaces 28,42 are substantial, and an effective gas and liquid-tight seal is formed between those surfaces. Moreover, the remanent stresses and substantial distortion of the sealing ring and the resilience of the plastics material of which it is made ensure that this seal is maintained despite plastics creep and backing-off of the closure which may occur to the point of eventual opening of the bottle by the consumer.

In addition to the side seal formed between the surfaces 18, 42, a further seal for the bottle is formed between the lower surface 27 of the upper fin 20 and the bottle surface 40. This top seal is in series relation to the side seal, and provides additional seal security for the bottle. However, it is to be regarded as subsidiary to the side seal because of its relative sensitivity to backing-off of the closure; in contrast, the side seal can only be impaired by gross reverse rotation of the closure, as would normally occur when the closure is being intentionally unscrewed by the user. As can be see from FIG. 4, the contact area involved in the top seal is essentially annular, the upper fins 20 being deformed by upward pressure from the container neck 16 and downward pressure from the bead 50.

A possible modification of the described embodiment is illustrated in FIG. 2 where the broken line 51 represents the base of one of a plurality of regularly spaced slots which are formed around the upper fin 20 so that the upper fin is formed of circumferentially spaced segments rather than being continuous as before. The slots prevent the upper fin from creating a seal with the container neck, and by so doing allow quick venting of gas within the bottle when the closure is being unscrewed. In this respect it will be noted that during unscrewing the upper fin leaves the bottle neck after the lower fin; any seal provided by the upper fin will accordingly delay venting. Both with or without the modification, venting should be complete before the screw threads are disengaged if the possibility of missiling of the closure is to be avoided.

The closure shown in the drawings may be formed by injection-moulding using conventional male and female mould parts. With suitable dimensioning the sealing ring can be "jumped-out" of the male mould part for ejection, with the attendant economies in moulding cost. During jumping-out the sealing ring pivots about the neck 19 in a clockwise direction and thereby makes the top surface 22 of the sealing ring sufficiently near to the vertical (as shown) to enable the sealing ring to be stripped from the cavity of the male mould part in which it is formed. The spacing of the sealing ring from the skirt should be sufficient to accommodate this tilting movement.

In the embodiment shown and described the sealing ring is rooted at the elbow between the closure panel and the peripheral skirt. However for some applications it may be appropriate to attach the sealing member to the closure panel proper, or alternatively to the skirt proper. Furthermore, arrangements other than the provision of an annular stop (50) may be used for determining the fitted position of the closure; for example, in a first possible modification of the described embodiment the annular stop 50 is omitted and the upper fin is arranged to engage the closure panel 10 at its undersurface 23, and in a second possible modification the stop 50 is again omitted and the sealing member alone is relied upon for determining the fitted position of the closure by virtue of its substantial rigidity when it is fully conformed to the bottle neck finish.

I claim:

1. A one-piece plastics closure for a container having a mouth-defining free end surface and a side surface, the closure having a closure panel, a skirt depending peripherally from the closure panel, and an annular sealing member located adjacent the junction of the closure panel and the skirt and attached by an integral flexible hinge allowing pivotal movement of the sealing member independently of the closure panel and the skirt, the sealing member having a first portion located for engagement with the free end surface of a said container when the closure is fitted on the container, and a second portion located so as in response to such engagement of the first portion by the container and consequent pivotal action of said hinge to be urged into engagement with the side surface of the container and thereby form a side seal for the container.

2. A closure according to claim 1, wherein the sealing member is a forked sealing ring having a body portion attached by the integral hinge, and first and second mutually divergent annular fins carried by the body portion and respectively forming the first and second portions of the sealing ring.

3. A closure according to claim 1 or claim 2, wherein the first portion is adapted to form a seal at its engagement with the free end surface of the container.

4. A closure according to claim 1 or claim 2, wherein the first portion is formed with apertures to prevent it from forming a seal at its engagement with the free end surface of the container.

5. A closure according to claim 2, wherein the first fin is formed of mutually spaced segments the spaces between which prevent the first fin from forming a seal at its engagement with the free end surface of the container.

6. A closure according to claim 1, 2 or 5, arranged for the first portion to determine the fitted condition of the closure by engagement with the closure panel.

7. A closure according to claim 6, which includes an annular projection which extends around the underside of the closure panel for engagement by the first portion in opposition to the engagement of the first portion by the container.

* * * * *